US006142305A

United States Patent [19]

Sembach

[11] Patent Number: 6,142,305

[45] Date of Patent: Nov. 7, 2000

[54] PROTECTIVE TRAY FOR LOOP ELECTRODE

[75] Inventor: Wolfgang U. Sembach, Pinellas County, Fla.

[73] Assignee: Aaron Medical Industries, Inc., St. Petersburg, Fla.

[21] Appl. No.: 09/397,575

[22] Filed: Sep. 16, 1999

[51] Int. Cl.[7] ..... B65D 85/30

[52] U.S. Cl. ..... 206/701; 206/438; 206/564

[58] Field of Search ..... 206/363, 364, 206/438, 564, 701

[56] References Cited

U.S. PATENT DOCUMENTS

| | | | |
|---|---|---|---|
| 4,366,901 | 1/1983 | Short | 206/364 |
| 4,779,727 | 10/1988 | Taterka et al. | 206/364 |
| 4,823,167 | 4/1989 | Manska et al. | 206/571 |
| 5,353,929 | 10/1994 | Foster | 206/438 |
| 5,848,691 | 12/1998 | Morris et al. | 206/438 |
| 5,947,284 | 9/1999 | Foster | 206/364 |
| 5,984,102 | 11/1999 | Tay | 206/701 |

*Primary Examiner*—David T. Fidei
*Attorney, Agent, or Firm*—A. W. Fisher, III

[57] ABSTRACT

A tray to protect the loop of a loop electrode during sterilization, shipping, handling and storage wherein the tray comprises a wall extending upwardly from a bottom wall to cooperatively form a cavity to receive the loop and distal end portion of the electrode shaft therein, a peripheral flange extending outwardly from the lower portion of the wall and an electrode limit to limit movement of the loop electrode within the cavity to limit lateral and longitudinal movement of the loop electrode relative to the tray to maintain the loop in spaced relationship relative thereto.

16 Claims, 3 Drawing Sheets

PROTECTIVE TRAY FOR LOOP ELECTRODE

BACKGROUND OF INVENTION

1. Field of the Invention

A tray to protect the loop of a loop electrode during sterilization, shipping, handling and storage.

2. Description of the Prior Art

The use of packages for packaging surgical and medical instruments is well known in the art. Such packages typically have at least one formed therein for receiving and retaining a particular instrument. The cavity is generally designed to conform to sections of the instrument. In order to retain the instrument in the package during shipping, handling, storage and sterilization various undercut projections or other securing methods are provided.

U.S. Pat. No. 3,476,114 and U.S. Pat. No. 3,476,115 describes a ligating instrument comprising an elongated tubular body member supporting a ligature within the shaft and terminating in an external loop which is intended to be drawn tightly about a severed vessel to achieve hemostasis. Such instruments are generally packaged within a unit which includes a relatively stiff retainer card upon which the instrument is mounted with one end of the instrument being held in place at one end of the retainer card by means of a die-cut securing strap positioned near this end of the card and the other, or loop, end of the instrument being held in place at the opposite end of the retainer card through the tensioned engagement of the loop upon a semicircular retainer card extension at such opposite end. The retainer card with a ligating instrument secured thereto is sealed within an outer flexible package, which maintains the instrument in sterile condition. To remove the instrument from the package and the instrument is separated from the exposed retainer card such packages have disadvantages for the use with loop-type instruments. There is the possibility that during transit and/or handling of the package, the instrument will shift within the package. Such movement could result in distortion of the shape of the loop making it more difficult to use the instrument. Another disadvantage of the package lies in the tendency of the loop to assume a relatively sharply cornered triangular set after being held in tensioned engagement with the semicircular extension of the retainer card for any length of time. Such a set, deviating from the preferred circular shape of the ligating loop, makes deployment of the instrument in a surgical operation more difficult.

U.S. Pat. No. 5,082,112 teaches a package for endoscopic ligating instrument possessing an elongated tubular body and a ligature contained therein which terminates outside one end of the tubular body in a contractible ligating loop. The package comprises a relatively rigid instrument holding member having a base, a first channel in the base of the instrument holding member for receiving, the elongated tubular body of the instrument, a ligating loop retaining member projecting upwardly from the base of the instrument holding member for receiving the ligating loop of the instrument therearound when the elongated tubular body of the instrument is received within the first channel of the instrument holding member. The ligating loop-retaining member is configured to maintain the approximate shape of the ligating loop in an open position and a cover member adapted to be mounted to and to enclose the instrument holding member.

U.S. Pat. No. 5,353,929 shows a package for an elongated surgical instrument having a handle portion, an elongated body portion and a working distal end. The package includes a first channel for receiving the handle portion, a second channel for receiving the body portion and a third channel for receiving the working distal end. At least one flange retains the handle portion in the first channel and a second plurality of flanges retains the elongated body portion in the second channel.

U.S. Pat. No. 5,386,908 relates to a package for endoscopic suture system including an elongated body, a suture, a needle attached to the suture and a suture retainer. The suture is connected to and extends from the elongated body into a suture retainer and terminating in the needle. The package includes a first channel for receiving the elongated body formed below the first plane. A first plurality of flanges retains the elongated body in the first channel and a second plurality of flanges retains the suture retainer in the second channel.

U.S. Pat. No. 5,474,179 discloses a non-contact protector for medical device including a head portion and a generally cylindrical neck portion attached thereto. The protector comprises a top portion; a pair of opposed side portions flexibly hinged to the top portion, a pair of bottom portions and a stabilizing means. The opposed side portions include locking means for retaining the protector in the closed position and side surfaces which are configured such that when the protector is in the closed position the surfaces surround but do not contact the head portion.

U.S. Pat. No. 5,485,917 describes a thermoformed package for a surgical instrument including a tray having at least one cavity with at least one undercut and an instrument can be quickly released from a cavity and from the package without touching the instrument. The package also has an interlocking projection for efficiently storing packages in a dispenser container.

Additional examples of the prior art are found in U.S. Pat. No. 5,050,732; U.S. Pat. No. 5,462,157 and U.S. Pat. No. 5,579,919.

SUMMARY OF THE INVENTION

The present invention relates to a tray to protect the loop of a loop electrode during sterilization, shipping, handling and coupled attached to an elongated shaft by a loop mounting member.

The tray comprises a wall including an inside wall surface, an outside wall surface and an upper wall surface formed between the upper portions thereof extending upwardly from a bottom surface. The inside wall surface and the bottom surface cooperatively form a cavity to receive the flexible wire loop and the distal end portion of the elongated shaft.

The tray further includes an electrode limit comprising a lateral electrode limit and a longitudinal electrode limit to restrict lateral and longitudinal movement of the loop electrode relative to the wall to maintain the flexible wire loop in spaced relationship relative the inside wall surface to prevent the flexible loop from being deformed or bent by engagement therewith.

The lateral electrode limit comprises a cradle formed in the rear portion or section of the wall configured to selectively receive and support a portion of the elongated shaft of the loop electrode therein to limit the lateral movement of the loop electrode relative to the tray to protect the flexible wire loop from engaging the inside wall surface of either side portion or section of the wall.

The longitudinal electrode limit comprises a limit member disposed in spaced relationship relative to the inside wall surface of the rear portion or section of the wall to cooperatively form a retention channel therebetween to selectively receive the mounting member of the loop electrode to limit the longitudinal movement of the loop electrode relative to the tray to prevent the flexible wire loop from engaging the inner wall surface of either forward portion or section or the rear portion or section of the wall.

To use, the loop electrode is held above the tray with the elongated shaft aligned with the cradle and the loop mounting member aligned with the retention channel such that the elongated shaft can be placed in the cradle through the electrode shaft access and the loop mounting member is placed in the retention channel to maintain the flexible wire loop in spaced relationship relative to the inside wall surface without the flexible wire loop touching the tray.

The loop electrode can be removed from the tray without the flexible wire loop touching the tray simply by rotating the loop electrode therefrom while bending the tray to remove the elongated shaft from the cradle through the electrode shaft access.

The tray and the loop electrode can then be placed in a package for sterilization, shipping, handling and storage.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
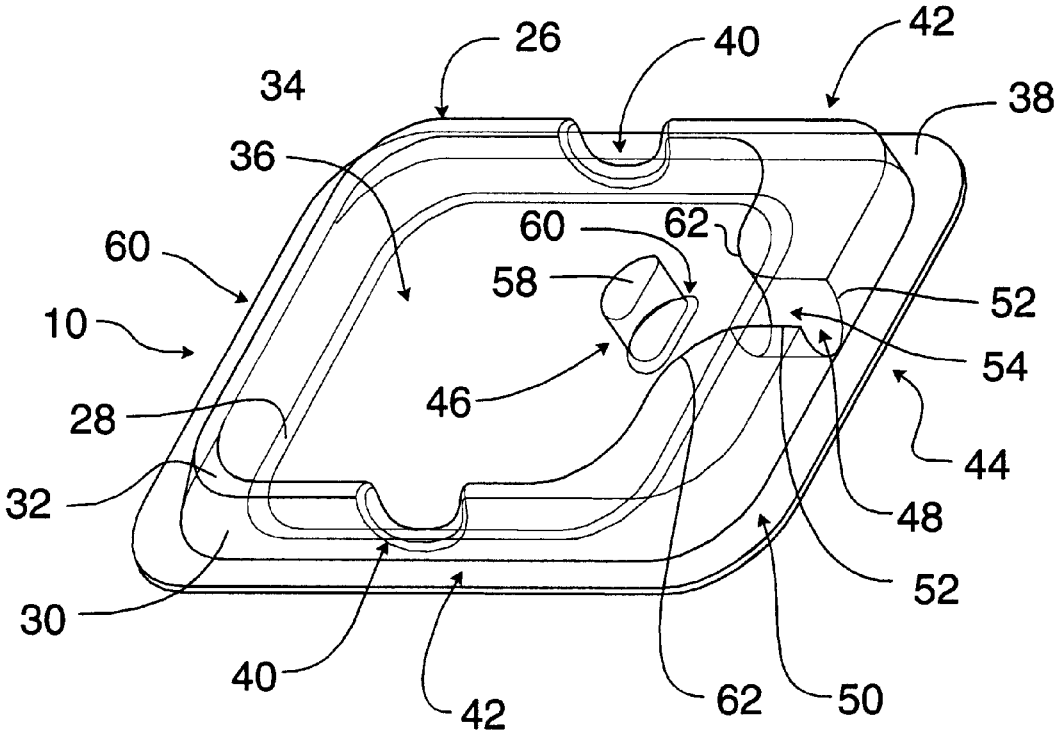
FIG. 1 is a perspective view of the tray of the present invention.
Figure 2:
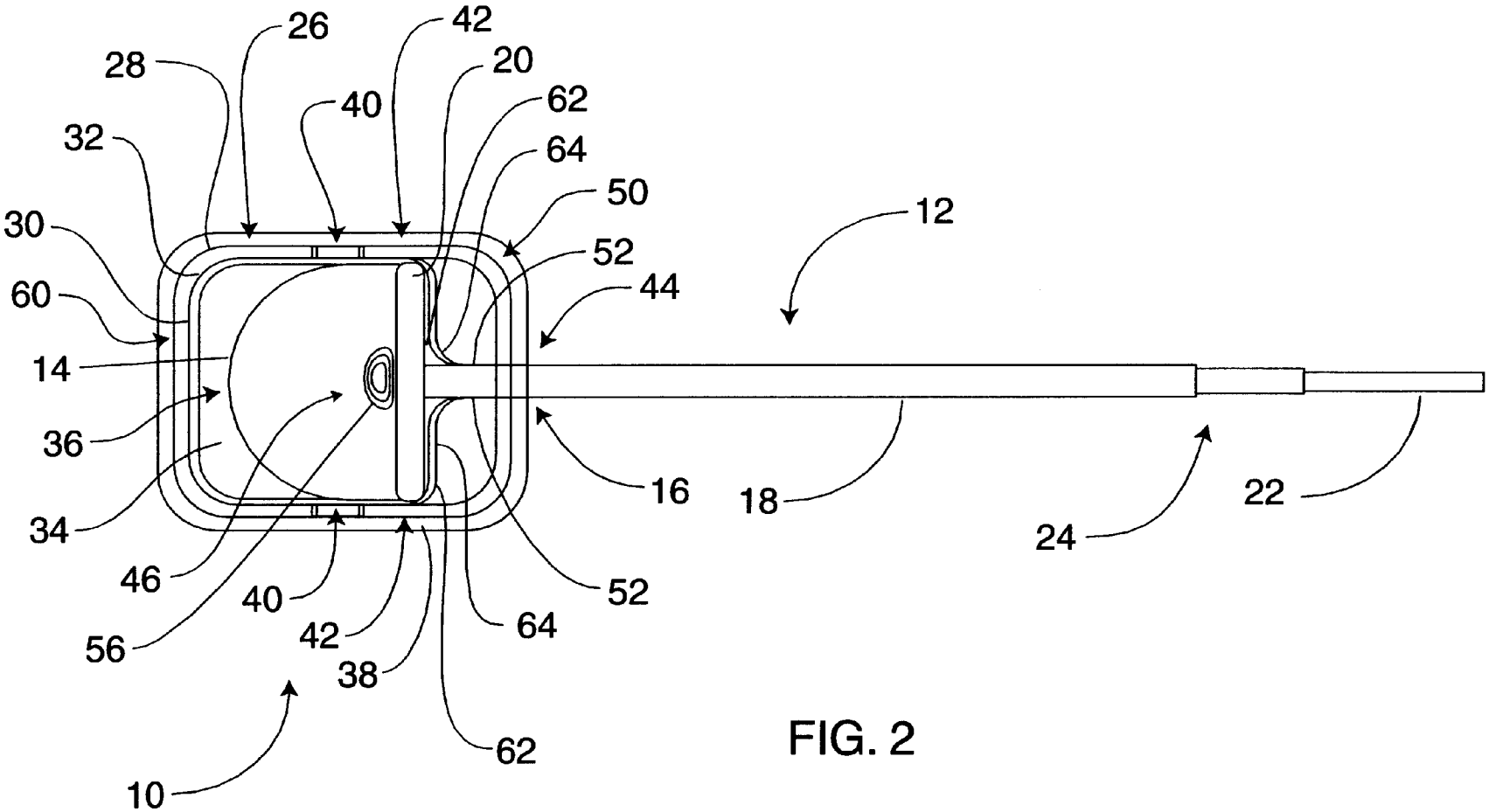
FIG. 2 is a top view of the tray of the present invention in combination with a loop electrode within a sealed package.

As best shown in FIGS. 1 and 2, the present invention relates to a tray generally indicated as 10 for a loop electrode generally indicated as 12 to protect the loop during sterilization, shipping, handling and storage as described more fully hereinafter.

As shown in FIG. 2, the loop electrode 12 comprises a flexible wire loop 14 coupled to the distal end portion generally indicated as 16 of an electrode member including an elongated shaft 18 and a loop mounting member 20, and an electrode 22 extending from the proximal end portion generally indicated as 24 of the elongated shaft 18 to the flexible wire loop 14 at the distal end portion 16.

Figure 3:
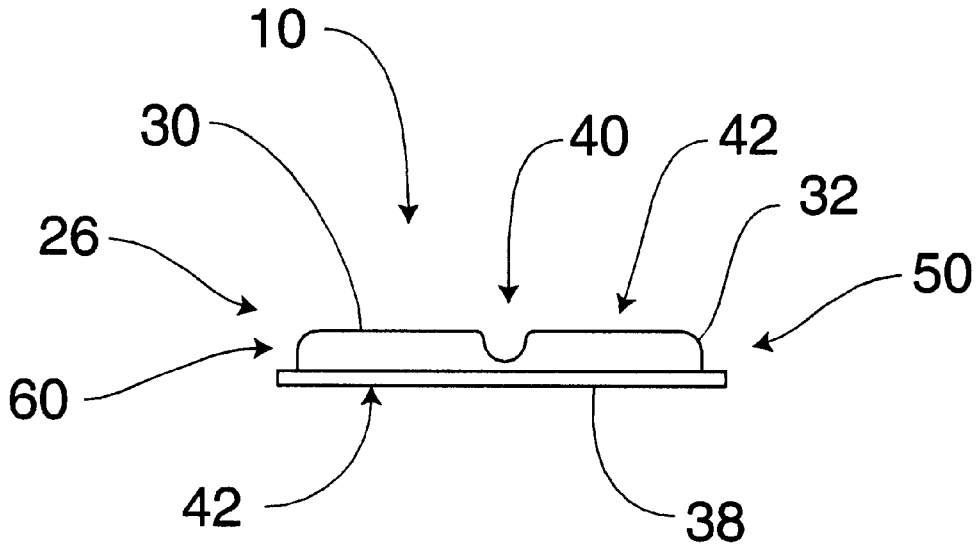
FIG. 3 is a side view of the tray of the present invention.

As best shown in FIGS. 1 and 2, the tray 10 comprises a wall generally indicated as 26 including an inside wall surface or panel 28, an outside wall surface or panel 30 and an upper wall surface or ledge 32 formed between the upper portions thereof extending upwardly from a substantially flat bottom surface or panel 34. The inside wall surface or panel 28 and the substantially flat bottom surface or panel 34 cooperatively form a cavity 36 to receive the flexible wire loop 14 and the distal end portion 16 of the elongated shaft 18. A tray support comprising a peripheral flange 38 extends outwardly from the lower portion of the outside wall surface or panel 30 of the wall 26. As shown in FIGS. 1 through 3, a concave or annular opening 40 is formed in each side portion or section each generally indicated as 42 of the wall 26.

As best shown in FIGS. 1 and 2, the tray 10 further includes an electrode limit comprising a lateral electrode limit generally indicated as 44 and a longitudinal electrode limit generally indicated as 46 to restrict lateral and longitudinal movement of the loop electrode 12 relative to the wall 26 to maintain the flexible wire loop 14 in spaced relationship relative the inside wall surface or panel 28 of the wall 26 to prevent the flexible loop 14 from being deformed or bent by engagement therewith.

Figure 4:
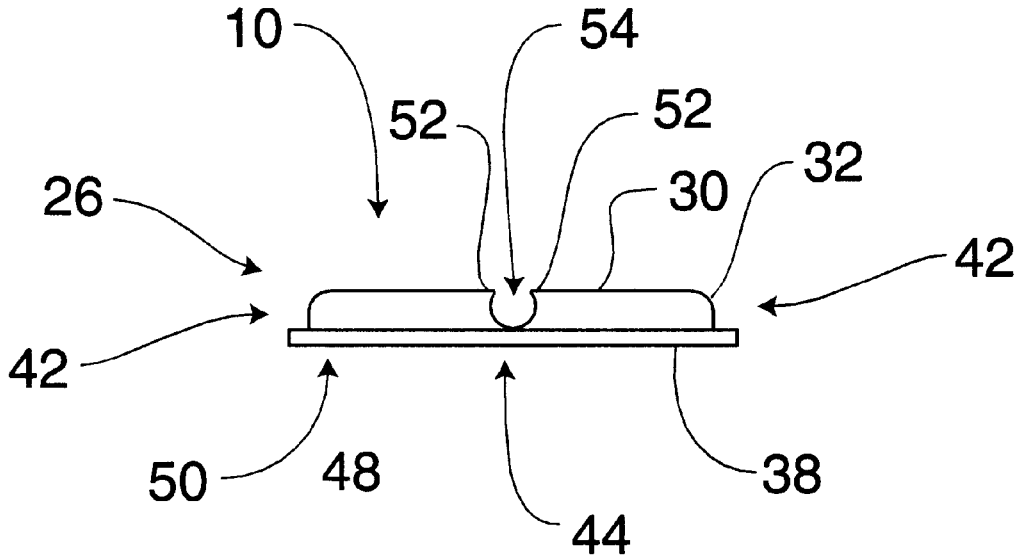
FIG. 4 is an end view of the tray of the present invention.

As shown in FIGS. 1, 2 and 4, the lateral electrode limit 44 comprises a cradle 48 configured to selectively receive and support a portion of the elongated shaft 18 of the loop electrode 12 therein to limit the lateral movement of the loop electrode 12 relative to the tray 10 to protect the flexible wire loop 14 from engaging the inside wall surface or panel 28 of either side portion or section 42 of the wall 26. The cradle 48 may comprise a substantially cylindrical channel having a diameter greater than the outside diameter of the elongated shaft 18 formed through the rear portion or section generally indicated as 50 of the wall 26 terminating in a pair of upper cradle edges each indicated as 52 to cooperatively form an upper electrode shaft access 54 formed in the upper wall surface or ledge 32 to selectively receive the elongated shaft 18 therethrough; while, the electrode shaft access 54 may comprise a slot having a width less than the outside diameter of the elongated shaft 18 to selectively retain the elongated shaft 18 within the cradle 48. As best shown in FIG. 4, the cradle 48 is disposed above the substantially flat bottom surface or panel 34 to support the loop electrode 12 in spaced relationship thereto as described more fully hereinafter.

As shown in FIGS. 1 and 2, the longitudinal electrode limit 46 comprises a limit member 56 disposed in spaced relationship relative to the inside wall surface or panel 28 of the rear portion or section 50 of the wall 26 to cooperatively form a retention channel 58 therebetween to selectively receive the mounting member 28 of the loop electrode 12 therein to limit the longitudinal movement of the loop electrode 12 relative to the tray 10 to prevent the flexible wire loop 12 from engaging either the forward portion or section 60 or the rear portion or section 50 of the wall 26. The limit member 56 may comprise a protrusion or post extending upwardly from the substantially flat bottom surface or panel 34. The upper wall surface or ledge 32 adjacent the inside wall surface or panel 28 on each side of the cradle 48 comprises an arcuate configuration 62 to conform to the arcuate shape of the intersection 64 between the distal end portion 65 of the elongated shaft 18 and the loop mounting member 20.

To use, the loop electrode 12 is held above the tray 10 with the elongated shaft 18 aligned with the electrode shaft access 54 and the cradle 48; while, the loop mounting member 20 is aligned with the retention channel 58 such that the elongated shaft 18 can be placed in the cradle 48 through the electrode shaft access 54 and the loop mounting member 20 is placed in the retention channel 58 to maintain the flexible wire loop 14 in spaced relationship relative to the inside wall surface or panel 28 above the substantially flat bottom surface or panel 34 without the flexible wire loop 14 touching the tray 10. So constructed, the tray 10 can receive and support loop electrodes of various sizes.

The tray 10 and the loop electrode 12 then can be placed in a package (not shown) for sterilization, shipping, handling and storage.

The loop electrode 12 can be removed from the tray 10 without the flexible wire loop 14 touching the tray 10 by rotating the loop electrode 12 while bending the tray 10 to remove the elongated shaft 18 from the cradle 48 through the electrode shaft access 54.

The tray 10 can be fabricated from any suitable materials such as polyethylene terephthalate, polyvinyl chloride, polypropylene and polystyrene or the like. The tray 10 is formed using conventional thermoforming processes. Initially, a sheet of plastic is heated to a sufficient temperature to be effectively formable. The heated plastic sheet is then placed over a mold to form the plastic into a configuration conforming to the contours of the mold. Finally, the formed plastic sheet is cooled and removed from the mold.

The package (not shown) can be constructed from coated or uncoated Tyvek, coated paper, non-porous plastic film or the like and sealed using conventional sealing techniques including heat sealing, pressure sealing, RF sealing, impulse sealing, ultrasonic sealing or the like.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A tray to support a loop electrode including a loop coupled to the distal end portion of an electrode shaft to protect the loop electrode, said tray comprises a wall extending upwardly from a bottom wall to cooperatively form a cavity to receive the loop and distal end portion of the electrode shaft therein and an electrode limit to limit movement of the loop electrode within said cavity, said electrode limit comprises a longitudinal electrode limit disposed to engage the distal end portion of the electrode shaft to restrict the longitudinal movement of the loop electrode relative to said tray comprising a limit member extending upwardly from said bottom wall disposed in spaced relationship relative to the rear portion of said wall to cooperatively form a retention channel therebetween to selectively receive the distal end portion of the electrode shaft of the loop electrode therein to limit the longitudinal movement of the loop electrode relative to said tray.

2. The tray of claim 1 further comprising a lateral electrode limit disposed to engage the electrode member to restrict lateral movement of the loop electrode relative to said tray.

3. A tray to support a loop electrode including a loop coupled to the distal end portion of an electrode shaft to protect the loop electrode said tray comprises a wall extending upwardly from a bottom wall to cooperatively form a cavity to receive the loop and distal end portion of the electrode shaft therein and an electrode limit to limit movement of the loop electrode within said cavity, said electrode limit comprises a lateral electrode limit and a longitudinal electrode limit to restrict lateral and longitudinal movement of the loop electrode relative to said wall to maintain the flexible wire loop in spaced relationship relative to said wall to prevent the flexible loop from being deformed or bent by engagement therewith, said lateral electrode limit comprises a cradle configured to selectively receive and support a portion of said elongated shaft of the loop electrode therein to limit the lateral movement of the loop electrode relative to said tray to prevent the flexible wire loop from engaging said wall and said longitudinal electrode limit comprises a limit member disposed in spaced relationship relative to the rear portion of said wall to cooperatively form a retention channel therebetween to selectively receive the mounting member of the loop electrode therein to limit the longitudinal movement of the loop electrode relative to said tray to prevent the flexible wire loop from engaging said tray, said cradle comprises a channel having a diameter greater than the outside diameter of the elongated shaft formed through the rear portion of said wall and said limit member comprises a protrusion extending upwardly from said bottom wall.

4. The tray of claim 2 wherein said lateral electrode limit comprises a cradle configured to selectively receive and support a portion of the elongated shaft of the loop electrode therein to limit the lateral movement of the loop electrode relative to said tray to prevent the flexible wire loop from engaging said tray.

5. The tray of claim 4 wherein said cradle is disposed above said bottom wall to support the loop electrode in spaced relationship thereto.

6. The tray of claim 4 wherein said cradle comprises a channel having a diameter greater than the outside diameter of the elongated shaft formed through the rear portion of said wall.

7. The tray of claim 6 wherein said channel terminates in a pair of upper cradle edges to cooperatively form an upper electrode shaft access formed in the rear portion of said wall to selectively receive the elongated shaft therethrough.

8. The tray of claim 7 wherein said electrode shaft access comprises a slot having a width less than the outside diameter of the elongated shaft to selectively retain the elongated shaft within said cradle.

9. The tray of claim 8 wherein said cradle is disposed above said bottom wall to support the loop electrode in spaced relationship thereto.

10. The tray of claim 3 wherein said channel terminates in a pair of upper cradle edges to cooperatively form an upper electrode shaft access formed in the rear portion of said wall to selectively receive the elongated shaft therethrough.

11. The tray of claim 10 wherein said upper electrode shaft access comprises a slot having a width less than the outside diameter of the elongated shaft to selectively retain the elongated shaft within said cradle.

12. The tray of claim 3 wherein said cradle is disposed above said bottom wall to support the loop electrode in spaced relationship thereto.

13. The tray of claim 1 wherein the distal end portion of said electrode shaft comprises a loop mounting member to be selectively received within said retention channel.

14. The tray of claim 13 wherein the rear portion of said wall on each side of said cradle comprises an arcuate configuration to conform to the arcuate shape of the end portion of said elongated shaft and said loop mounting member.

15. The tray of claim 3 wherein the distal end portion of said electrode shaft comprises a loop mounting member to be selectively received within said retention channel.

16. The tray of claim 15 wherein the rear portion of said wall on each side of said cradle comprises an arcuate configuration to conform to the arcuate shape of the end portion of said elongated shaft and said loop mounting member.

* * * * *